US011019921B2

(12) United States Patent
Liss et al.

(10) Patent No.: US 11,019,921 B2
(45) Date of Patent: Jun. 1, 2021

(54) SHELVING UNIT WITH CAPACITY INCREASING SHELVING

(71) Applicant: Edsal Manufacturing Company, Inc., Chicago, IL (US)

(72) Inventors: Mitchell Liss, Northbrook, IL (US); Christopher Quick, Mokena, IL (US); Mitchell E. Bianchin, Villa Park, IL (US)

(73) Assignee: Edsal Manufacturing Company, Inc., Chicago, IL (US)

( * ) Notice: Subject to any disclaimer, the term of this patent is extended or adjusted under 35 U.S.C. 154(b) by 0 days.

(21) Appl. No.: 16/689,468

(22) Filed: Nov. 20, 2019

(65) Prior Publication Data

US 2020/0163455 A1 May 28, 2020

Related U.S. Application Data

(60) Provisional application No. 62/772,133, filed on Nov. 28, 2018, provisional application No. 62/771,856, filed on Nov. 27, 2018.

(51) Int. Cl.
*A47B 57/48* (2006.01)
*A47B 96/02* (2006.01)
(Continued)

(52) U.S. Cl.
CPC ..... *A47B 57/485* (2013.01); *A47B 47/021* (2013.01); *A47B 47/028* (2013.01);
(Continued)

(58) Field of Classification Search
CPC ..... G09F 19/00; A47B 57/485; A47B 47/021; A47B 96/021; A47B 47/0083; A47B 55/02; A47B 57/22; A47B 47/082; A47B 57/50; A47B 57/00; A47B 57/06; A47B 57/12; A47B 57/14; A47B 57/20; A47B 57/30; A47B 57/36; A47B 57/38; A47B 57/48; A47B 57/487; A47B 47/00; A47B 47/02; A47B 47/045; A47B 96/02; A47B 96/024
(Continued)

(56) References Cited

U.S. PATENT DOCUMENTS 3,986,462 A * 10/1976 Heft ..... A47B 96/02 108/188
4,391,378 A * 7/1983 Secon ..... A47F 5/13 108/109

(Continued)

*Primary Examiner* — Jennifer E. Novosad
(74) *Attorney, Agent, or Firm* — Wood Herron & Evans LLP

(57) ABSTRACT

A shelving unit includes a plurality of posts, a plurality of shelf-supporting beams attached to the plurality of posts to form a shelf support frame, and a shelf. The shelf has a plurality of sides seated on the shelf support frame. The plurality of the sides of the shelf includes a depending flange. At least one of the depending flanges extends downwardly along a respective shelf-supporting beam between about 30% and about 100% of the height of the shelf-supporting beam. Another shelf unit is further disclosed where the shelves include a color that corresponds to a color-coded system for organizing the storage of items on the shelving unit. A method of organizing a shelving unit utilizing the color-coded shelf system is also disclosed.

9 Claims, 4 Drawing Sheets

(51) Int. Cl.

| | |
|---|---|
| ***A47B 47/02*** | (2006.01) |
| ***A47B 57/50*** | (2006.01) |
| ***A47B 55/02*** | (2006.01) |
| ***A47B 57/22*** | (2006.01) |
| ***A47B 47/00*** | (2006.01) |
| *G09F 19/00* | (2006.01) |

(52) U.S. Cl.
CPC ..... *A47B 55/02* (2013.01); *A47B 57/22* (2013.01); *A47B 57/50* (2013.01); *A47B 96/021* (2013.01); *A47B 47/0083* (2013.01); *G09F 19/00* (2013.01)

(58) Field of Classification Search
USPC ..... 211/119, 190, 207, 187, 181.1, 186, 117
See application file for complete search history.

(56) References Cited

U.S. PATENT DOCUMENTS 4,754,712 A * 7/1988 Olson ..... A47B 57/265 108/107
4,852,501 A * 8/1989 Olson ..... A47B 57/265 108/107
4,964,350 A * 10/1990 Kolvites ..... A47B 47/04 108/107
5,221,014 A * 6/1993 Welch ..... A47B 55/02 211/181.1
5,326,062 A * 7/1994 Remmers ..... A47B 55/02 211/106
5,351,842 A * 10/1994 Remmers ..... A47B 96/028 108/152
5,695,079 A * 12/1997 Peay ..... A47F 5/0884 211/118
5,779,069 A * 7/1998 Scully ..... A47B 96/02 211/153
5,797,503 A * 8/1998 Stevens ..... A47B 31/00 108/107
5,960,968 A * 10/1999 Wang ..... A47B 57/545 108/147.13
5,971,175 A * 10/1999 Bustos ..... A47F 5/13 211/187
6,286,691 B1 * 9/2001 Oberhaus ..... A47F 5/0892 211/113
6,286,694 B1 * 9/2001 Battaglia ..... A47B 55/02 108/107
7,059,484 B1 * 6/2006 Goldberg ..... A47B 47/0083 211/153
D568,005 S * 4/2008 McBride ..... D30/143
7,798,341 B2 * 9/2010 Richardson ..... A47F 5/0892 211/119
8,025,163 B2 * 9/2011 McAllister ..... A47B 96/028 211/90.03
8,540,090 B2 * 9/2013 Caveney ..... H02G 3/0608 211/119
8,646,624 B2 * 2/2014 Fernandez ..... A47B 47/022 211/90.02
9,661,921 B1 * 5/2017 Tsai ..... A47B 47/0083
9,713,379 B1 * 7/2017 Tsai ..... A47B 47/0083
10,390,618 B2 * 8/2019 Will ..... A47F 5/083
2002/0023888 A1 * 2/2002 Wynne ..... A47B 96/025 211/119
2002/0130098 A1 * 9/2002 Simard ..... A47F 5/01 211/181.1
2003/0164347 A1 * 9/2003 Bouvier, Jr. ..... A47B 43/006 211/117
2005/0103734 A1 * 5/2005 Saltzberg ..... A47B 96/1441 211/187
2006/0157435 A1 * 7/2006 Oberhaus ..... A47F 5/01 211/187
2007/0045209 A1 * 3/2007 Richardson ..... A47B 96/024 211/187
2007/0108147 A1 * 5/2007 Chen ..... A47B 47/00 211/187
2007/0119805 A1 * 5/2007 Nawrocki ..... A47B 55/02 211/119
2011/0042334 A1 * 2/2011 Sucevich ..... A47F 5/0025 211/71.01
2011/0290750 A1 * 12/2011 Lim ..... A47B 96/021 211/153
2014/0034593 A1 * 2/2014 Chen ..... A47B 47/021 211/134
2014/0261107 A1 * 9/2014 Sabounjian ..... A47B 96/024 108/147.13
2015/0069000 A1 * 3/2015 Rosen ..... A47B 47/0058 211/186
2015/0305494 A1 * 10/2015 Shah ..... A47B 47/0083 108/42
2017/0208950 A1 * 7/2017 Tsai ..... F16B 7/00
2017/0211604 A1 * 7/2017 Tsai ..... A47B 47/0083
2017/0224106 A1 * 8/2017 Sabounjian ..... A47B 57/545
2018/0279782 A1 * 10/2018 Liss ..... A47B 47/021
2019/0125077 A1 * 5/2019 Liss ..... A47B 47/0083
2019/0290000 A1 * 9/2019 Davis ..... A47B 57/34
2020/0054125 A1 * 2/2020 Robinson ..... A47B 96/028
2020/0163455 A1 * 5/2020 Liss ..... A47B 57/485
2020/0297110 A1 * 9/2020 Lim ..... A47B 55/02

* cited by examiner

SHELVING UNIT WITH CAPACITY INCREASING SHELVING

CROSS-REFERENCE TO RELATED APPLICATIONS

This application claims the benefit of U.S. Provisional Patent Application Ser. No. 62/771,865, filed on Nov. 27, 2018 and U.S. Provisional Patent Application Ser. No. 62/772,133, filed Nov. 28, 2018, the disclosures of which are incorporated by reference herein in their entirety.

FIELD OF THE INVENTION

This invention relates to shelving units, and more particularly to shelves that "wrap around" shelf-supporting beams of the shelving units to increase the load-bearing capacity of the shelving unit. The invention also relates to a shelving unit having color-coded shelves that provide for enhanced organization of storage on the shelves.

BACKGROUND OF THE INVENTION

Shelving units are commonly used for storing various items in a space-efficient manner. Typical shelving units may include four or more vertical supporting posts, any suitable number of shelf-supporting beams extending respectively between the front pair and rear pair of posts, and a corresponding number of shelves resting on and supported by the beams. Such shelving units may be constructed at least partially of sheet metal or formed steel components and are commonly referred to as steel shelving or storage units.

As loads are applied to such shelving units, such as by loading heavy items onto the shelves thereof, the shelves are susceptible to undesirable bowing or bending out of their positions, particularly when strained beyond their capacity to remain in their design position. This bowing presents undesirable structural responses and could lead to shelving failure. For example, undue bowing or bending of a shelving unit under load could permanently deform the shelf, allowing the shelf to pull away from the shelf-supporting beams of the shelving unit thereby rendering the shelf inoperable for future use, or the shelf could fail thereby catastrophically destroying the shelving unit.

Some attempts have been made to address these issues. By way of example, Applicant's prior U.S. application Ser. No. 15/937,061, filed Mar. 27, 2018, the disclosure of which is incorporated by reference herein in its entirety, discloses a number of tie members, such a tie bars and tie rods, that prevent or limit the shelf-supporting beams from twisting or otherwise distorting away from their original positions, to thereby increase the load-bearing capacity of the shelving unit.

Shelving units are commonly used for storing a wide variety of items in a space-efficient manner. However, such shelving units can quickly become disorganized with items being placed on the shelves in a random manner that makes locating desired items frustrating and time consuming. In this regard, for conventional shelving there is typically no means to allow a user to quickly know on what shelf a particular item is located.

While such designs as those disclosed in Applicant's prior application are generally successful for their intended purpose, manufacturers continually strive to improve the structural integrity and load-bearing capacity of shelving units in an efficient and cost-effective manner. Moreover, there is a need for an improved system and method for organizing the storage items on the shelving unit in an improved manner and allowing a user to more quickly know where a desired item may be stored.

SUMMARY OF THE INVENTION

A shelving unit includes a plurality of posts, a plurality of shelf-supporting beams, and a shelf. The plurality of shelf supporting beams attach to the plurality of posts to form a shelf support frame. The plurality of shelf-supporting beams may also include a front shelf-supporting beam, a rear shelf-supporting beam, and a pair of side shelf-supporting beams to support the shelf. The shelf sits upon the shelf support frame. Optionally, the shelf may include a wire rack. The shelving unit may include a plurality of shelf support frames and a plurality of shelves engaged with the respective shelf support frames.

In an exemplary embodiment, the shelf include a generally planar portion with depending flanges extending from the generally planar portion of the shelf at an angle between about 75 degrees to about 90 degrees. At least one of the depending flanges of the shelf extends downwardly along a respective shelf-supporting beam that the shelf sits upon. Further, the shelf may include a depending flange for each of the shelf-supporting beams. The depending flange may extend downwardly along the shelf-supporting beam between about 30% and about 100% of the height of the shelf-supporting beam.

Alternatively, each of the depending flanges of the shelf may extend downwardly along a respective shelf-supporting beam between about 30% and about 100% of the height of the shelf-supporting beam. More specifically, at least one of the depending flanges may extend downwardly from the shelf along a respective shelf-supporting beam between about 50% and about 100% of the height of the shelf-supporting beam. Even more specifically, at least one of the depending flanges may extend downwardly from the shelf along a respective shelf-supporting beam about 50% of the height of the shelf-supporting beam.

The plurality of self-supporting beams may be attached to the plurality of posts by means of releasable fastening means. The releasable fastening means may include a plurality of locking pins and a plurality of corresponding keyholes for the respective locking pins. The locking pins are configured to be inserted into and received by the corresponding keyholes in order to lock the shelf-supporting beams in place.

In one embodiment, a shelving unit may feature a shelf that includes a color that corresponds to a color-coded system for organizing the storage of items on the shelving unit. Preferably, each shelf has a unique color. Optionally, the shelf may include a colored wire rack corresponding to the color-coded system. The shelving unit may further include a storage container colored to match a corresponding colored shelf.

In another embodiment, a method of organizing a shelving unit includes providing a plurality of posts, providing a plurality of shelf-supporting beams, and providing a shelf. The plurality of shelf-supporting beams attach to the plurality of posts to form a shelf support frame. The shelf sits upon the shelf support frame. For this method of organizing, the shelf includes a color that corresponds to a color-coded system for arranging the storage of items on the shelving unit. Optionally, the shelf may include a colored wire rack. The method of organizing a shelving unit may further include assigning a category of item to a color, the color corresponding to a colored shelf. Further, the method may include stowing an item on the colored shelf based on visual recognition of colored shelf and the category of item assigned to the color of the colored shelf. Additionally, the method may also include utilizing a storage container that is colored to match a corresponding colored shelf for stowing items.

BRIEF DESCRIPTION OF THE DRAWINGS

Various additional features and advantages of the invention will become more apparent to those of ordinary skill in the art upon review of the following detailed description of one or more illustrative embodiments taken in conjunction with the accompanying drawings. The accompanying drawings, which are incorporated in and constitute a part of this specification, illustrate one or more embodiments of the invention and, together with the general description given above and the detailed description given below, serve to explain the one or more embodiments of the invention.

DETAILED DESCRIPTION

Figure 1:
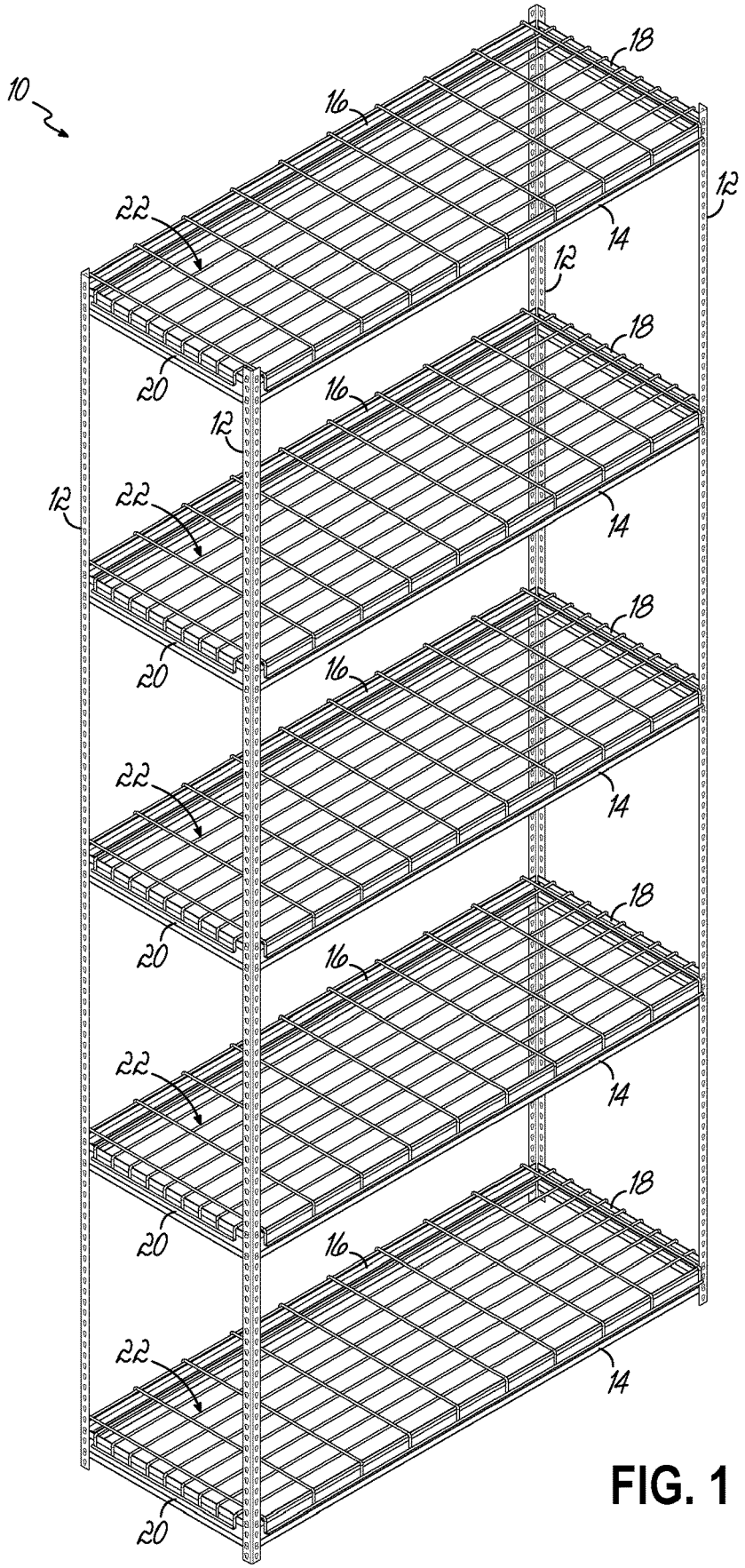
FIG. 1 is an isometric view of an exemplary shelving unit in accordance with an embodiment of the invention.
Figure 2:
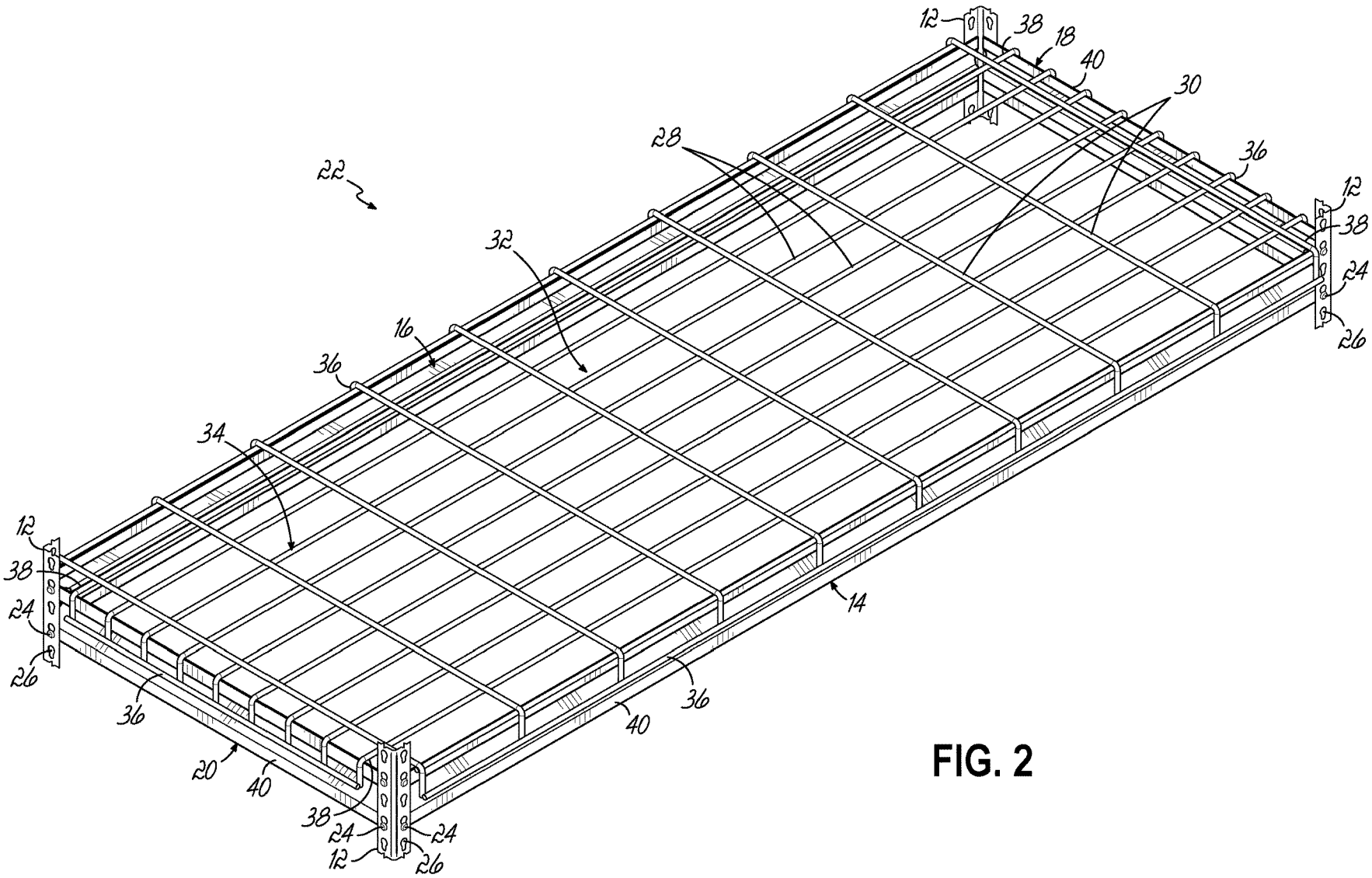
FIG. 2 is a perspective view of an individual shelf of the shelving unit of FIG. 1.
Figure 3:
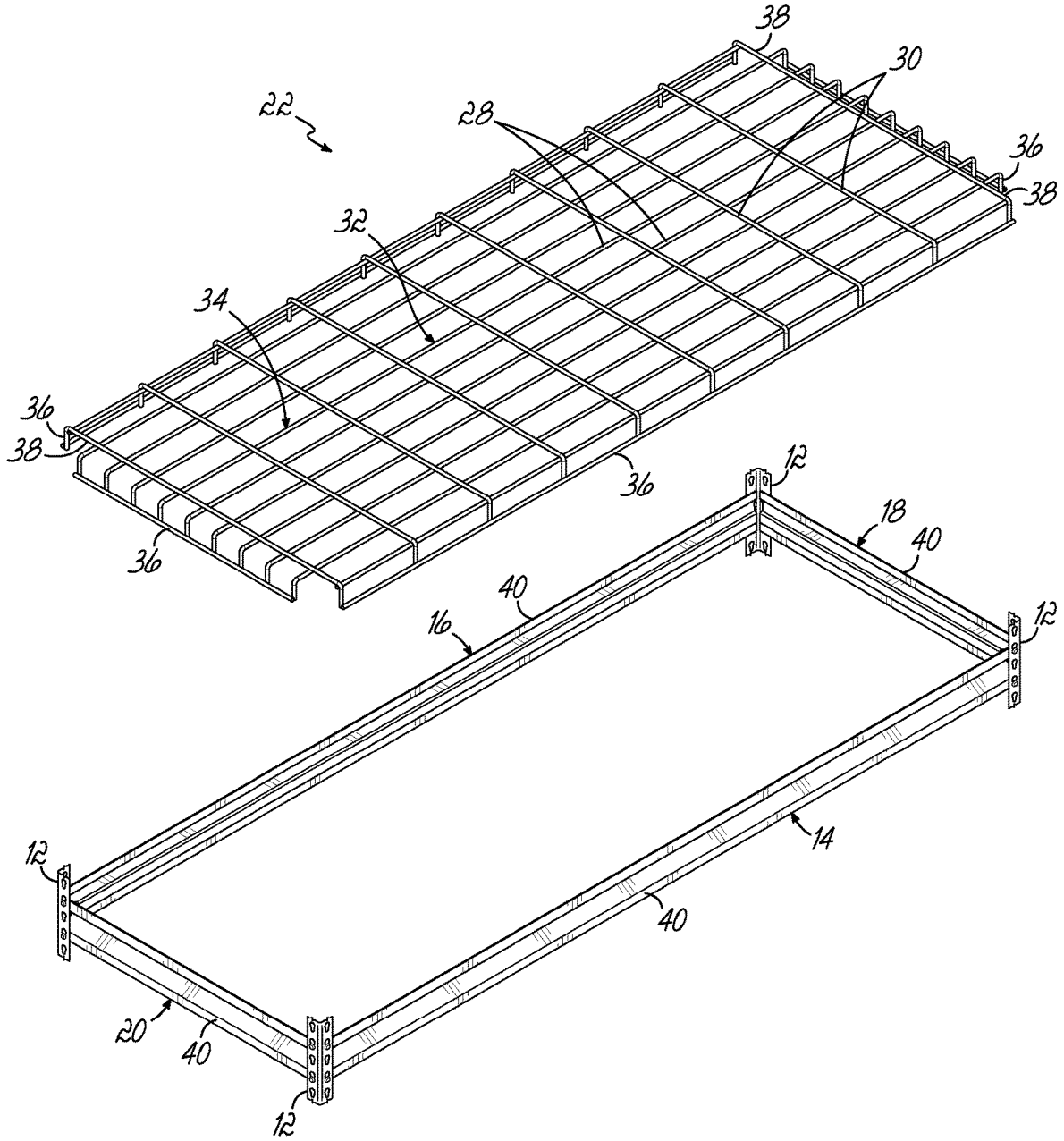
FIG. 3 is an exploded view of the shelf of FIG. 2.

As shown in FIGS. 1 and 2, a shelving unit 10 includes four corner posts 12 arranged in a generally rectangular configuration. A front pair of corner posts 12 cooperate to carry a front horizontal shelf-supporting beam 14, a rear pair of corner posts 12 cooperate to carry a rear horizontal shelf-supporting beam 16, and corresponding pairs of front and rear corner posts 12 cooperate to carry side horizontal shelf-supporting beams 18, 20. The horizontal shelf-supporting beams 14, 16, 18, 20 are configured to support a shelf 22. In an exemplary embodiment, the horizontal shelf-supporting beams 14, 16, 18, 20 are configured to be selectively coupled to the posts 12 via releasable fastening means. By way of example and without limitation, each of the horizontal shelf-supporting beams 14, 16, 18, 20 may include one or more locking pins 24 that are configured to be received within corresponding keyholes 26 that are distributed along the length of the corner posts 12. The coupling of the horizontal shelf-supporting beams 14, 16, 18, 20 to the corner posts 12 may be adjustable such that the number of horizontal shelf-supporting beams 14, 16, 18, 20 and their respective heights along the posts 12 may be varied as desired. The illustrated shelving unit 10 in includes five horizontal shelves 22, such that a total of five sets of front, rear, and side horizontal shelf-supporting beams 14, 16, 18, 20 are used. However, it will be appreciated that any number of shelves 22 and corresponding horizontal shelf-supporting beams 14, 16, 18, 20 may be used, as may be desired.

Figure 4:
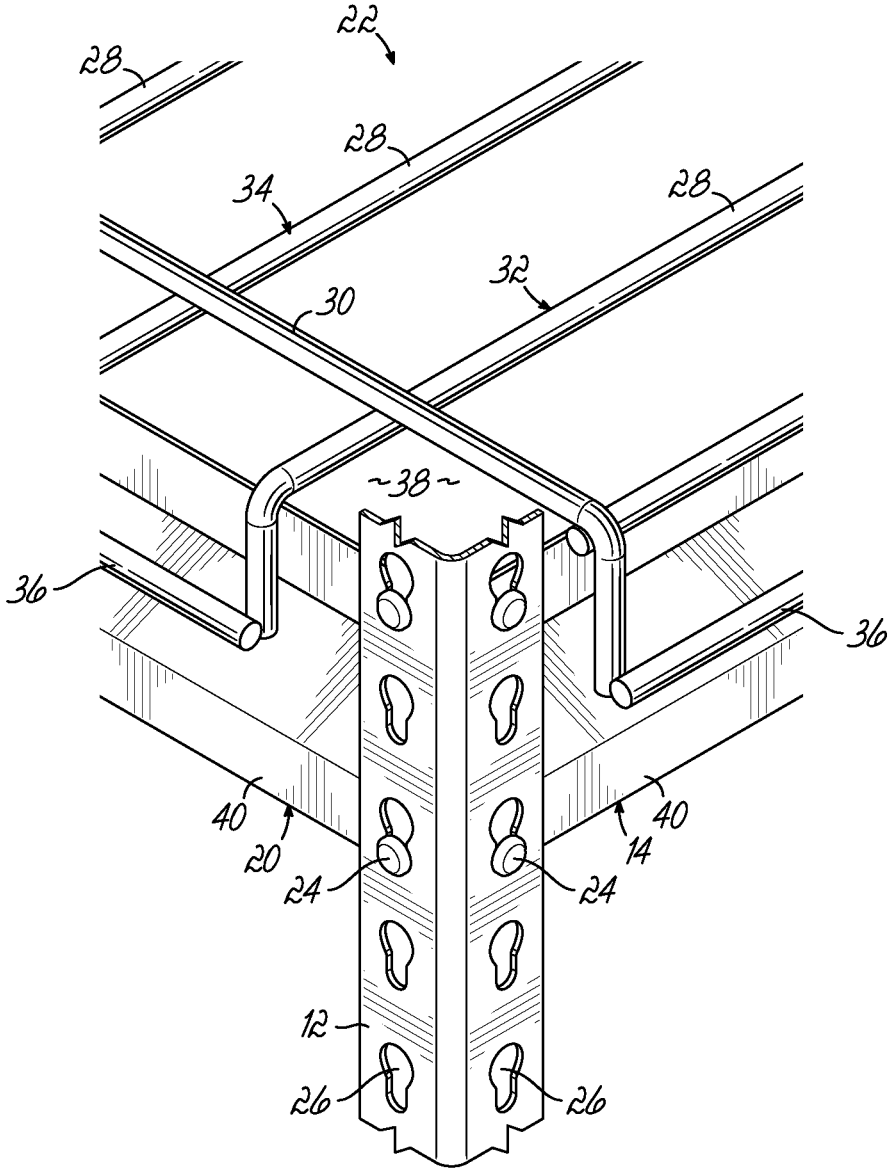
FIG. 4 is an enlarged view of a corner portion of the shelf of FIG. 2.

As shown in FIGS. 2 and 4, each horizontal shelf-supporting beam 14, 16, 18, 20 has two locking pins 24 located at each of the terminal ends of the shelf-supporting beams 14, 16, 18, 20 that corresponds to keyholes 26 on the corner posts 12 for a coupling therebetween. The locking pins 24 of the shelf-supporting beams 14, 16, 18, 20 have radially enlarged head portions sized to sufficiently facilitate coupling of the shelf-supporting beams 14, 16, 18, 20 to the posts 12 via the keyholes 26. However, it will be understood that other suitable configurations of the locking pins 24 and keyholes 26 could also be used without departing from the scope of the invention. For achieving the coupling, each locking pin 24 is inserted into and received by a corresponding keyhole 26 of the respective front and rear sets of corner posts 12. As shown in the exemplary embodiment, the radially enlarged portion of the locking pin 24 may then be moved to a lower position along a narrowed portion of the respective keyhole 26 in order to lock the shelf-supporting beams 14, 16, 18, 20 in place. Each of the terminal ends of the shelf-supporting beams are coupled to a corner post 12 to create a level, horizontal structure, for supporting a shelf 22.

In an exemplary embodiment, one or more of the shelves 22 of the shelving unit 10, and preferably each of the shelves 22 of the shelving unit 10, may be configured as a wire rack, including a plurality of elongate members 28, 30 extending in generally orthogonal directions to form a grid configuration 32 having generally rectangular or square voids. The shelf 22 includes a generally planar portion 34 and depending tabs or flanges 36 formed by the elongate members 28, 30 but extending downwardly from the planar portion 34. In one embodiment, the depending flanges 36 may extend downwardly from the planar portion 34 at an angle of about 90 degrees. In an alternative embodiment, the depending flanges 36 may form an acute angle relative to the planar portion (e.g., so that the depending flanges 36 are directed inwardly toward the center of the shelf 22) between, for example and without limitation, 75 degrees and 90 degrees. Other acute angles may also be possible, however. As explained in more detail below, the depending flanges 36 are configured to interact with the shelf-supporting beams 14, 16, 18, 20 in such a way as to increase the load-carrying capacity of the shelf 22 and the shelving unit 10.

To this end and in one aspect of the present invention, the flanges 36 may depend from each of the sides of the shelf 22 (e.g., from each of the four sides of the rectangular shelf 22). Thus, not only do the front and rear sides of the shelf 22 include a depending flange 36, but the lateral sides of the shelf 22 also include depending flanges 36. As illustrated in FIGS. 2 and 4, the shelves 22 are configured to engage with the shelf-supporting beams 14, 16, 18, 20 so that the flanges 36 are disposed outboard of the shelf-supporting beams 14, 16, 18, 20. The flanges 36 seat the shelves 22 on the shelf-supporting beams 14, 16, 18, 20 so that lateral movements of the shelves 22 relative to the shelf-supporting beams 14, 16, 18, 20 are generally restricted. Upward vertical movement of the shelves 22 relative to the shelf-supporting beams 14, 16, 18, 20 is generally not prohibited, however. Instead, the load carried by the shelves 22 generally presses the shelves 22 to the tops of the shelf-supporting beams 14, 16, 18, 20 (e.g., typically no external fastener). The shelves 22 include a gap or cutout 38 to provide for the corner posts 12.

In accordance with another aspect of the present invention, a relationship may exist between the length of the flanges 36 of the shelf 22 and the height of the shelf-supporting beams 14, 16, 18, 20 that support the shelf 22. By way of example and without limitation, in one embodiment, the flanges 36 extend downwardly along the outer wall 40 of the shelf-supporting beams 14, 16, 18, 20 between about 30% to about 100% of the height of the shelf-supporting beams 14, 16, 18, 20. In a preferred embodiment, the flanges 36 extend downwardly along the outer wall 40 of the shelf-supporting beams 14, 16, 18, 20 between about 50% to about 100% of the height of the shelf-supporting beams 14, 16, 18, 20. In another preferred embodiment, flanges 36 extend downwardly along the outer wall 40 of the shelf-supporting beams 14, 16, 18, 20 for about 50% of the height of the shelf-supporting beams 14, 16, 18, 20. In this embodiment, for example and without limitation, the flanges 36 extend to about the midpoint of the shelf-supporting beams 14, 16, 18, 20.

Applicant believes that such embodiments, wherein the flanges extend downwardly along the shelf-supporting beams 14, 16, 18, 20 for about 50% or more of the height of the shelf-supporting beams 14, 16, 18, 20, provide certain benefits that increase the load-bearing capacity of the shelves 22. In this regard, as loads are applied to the shelf 22, such as by loading heavy items onto the shelf 22, an initial amount of deformation causes the flanges 36 to more deeply engage or grip to the shelf-supporting beams 14, 16, 18, 20 thereby preventing further undesirable movement of the shelf 22 downwardly within the frame formed by the shelf-supporting beams 14, 16, 18, 20 (e.g., prevent shelf fall through). Moreover, it is believed that the extended length of the flanges 36 along the shelf-supporting beams 14, 16, 18, 20 more uniformly distributes the forces acting on the shelf-supporting beams 14, 16, 18, 20, thereby limiting the amount of twist or other movement of the support beams 14, 16, 18, 20 away from their original positions. These aspects, alone or in combination with each other, provide for an increase in the loads carried by the shelves 22.

As discussed above, shelving units, such as shelving unit 10, are used to store a wide variety of items in a space-efficient manner. However, such storage can quickly become disorganized, making the location of a desired item frustrating and time consuming. In another aspect of the present invention, such shortcomings may be addressed through the use of a color-coded system that enhances the organization of the various items on the shelving unit. By way of example and without limitation, in an embodiment shelving unit 10 includes five shelves 22. In an embodiment, the wire deck that forms the shelves 22 may be color coded. For example and without limitation, the lower most shelf 22 may be red, the next shelf 22 up may be yellow, followed by shelves 22 being green, blue, and orange. Of course, any array of colors may be used on the shelves so long as the various shelves 22 may be easily visually differentiated from each other. Additionally or alternatively, items may be stored in bins or totes on the shelves 22 that have the color-code associated therewith. For example and without limitation, the lids of the bins may be colored to match the colored shelf.

With the shelves 22 of the shelving unit 10 (e.g., and/or the bins stored thereon) being colored, a user may assign certain categories of items to certain colors and then store corresponding items on the shelf having that certain color. By way of example and without limitation, a user may assign sporting equipment to the color red, and then store sporting equipment on the shelf 22 having a red color. A user may likewise assign automotive items, holiday decorations, tools, etc. a certain color and store those items on a correspondingly colored shelf. In this way, when a user wants a certain item, they only need to know the color assigned to that item and to locate the shelf having that color. Such a color-coded system improves the organization of items to be stored and allows a user to locate a desired item more quickly and without the frustration accompanied by scouring a disorganized shelving unit.

While the present invention has been illustrated by the description of various embodiments thereof, and while the embodiments have been described in considerable detail, it is not intended to restrict or in any way limit the scope of the appended claims to such detail. Thus, the various features discussed herein may be used alone or in any combination. Additional advantages and modifications will readily appear to those skilled in the art. The invention in its broader aspects is therefore not limited to the specific details and illustrative examples shown and described. Accordingly, departures may be made from such details without departing from the scope of the general inventive concept.

What is claimed is:

1. A shelving unit, comprising:

a plurality of posts, wherein each post is adapted to be supported at a bottom end thereof by an underlying surface;

a plurality of shelf-supporting beams attached to the plurality of posts to form a shelf support frame; and a single monolithic shelf having a plurality of sides seated on the shelf support frame, wherein each of the sides of the shelf includes a depending flange, wherein each of the depending flanges extends downwardly along a respective shelf-supporting beam between 30% and 100% of a height of the shelf-supporting beam.

2. The shelving unit of claim 1, wherein the plurality of shelf-supporting beams further comprises:

a front shelf-supporting beam;

a rear shelf-supporting beam; and a pair of side shelf-supporting beams.

3. The shelving unit of claim 1, wherein the shelf includes a wire rack.

4. The shelving unit of claim 1, wherein the shelf includes a generally planar portion, and wherein the depending flanges extend from the generally planar portion at an angle between 75 degrees to 90 degrees.

5. The shelving unit of claim 1, wherein the shelving unit includes a plurality of shelf support frames and a plurality of shelves engaged with a respective shelf support frame.

6. The shelving unit of claim 1, wherein the at least one of the depending flanges extends downwardly along a respective shelf-supporting beam between 50% and 100% of the height of the shelf-supporting beam.

7. The shelving unit of claim 6, wherein the at least one of the depending flanges extends downwardly along a respective shelf-supporting beam 50% of the height of the shelf-supporting beam.

8. The shelving unit of claim 1, wherein the plurality of self-supporting beams are attached to the plurality of posts by means of releasable fastening means.

9. The shelving unit of claim 8, wherein the releasable fastening means comprises:

a plurality of locking pins; and a plurality of corresponding keyholes, wherein the locking pins are configured to be inserted into and received by the corresponding keyholes in order to lock the shelf-supporting beams in place.

* * * * *